US008982020B2

(12) United States Patent
Sun et al.

(10) Patent No.: US 8,982,020 B2
(45) Date of Patent: Mar. 17, 2015

(54) PIXEL DRIVING CIRCUIT OF ORGANIC-LIGHT EMITTING DIODE

(71) Applicant: Chunghwa Picture Tubes, Ltd., Taoyuan (TW)

(72) Inventors: Bo-Jhang Sun, Kaohsiung (TW); Chin-Hai Huang, Taoyuan County (TW); Szu-Chi Huang, Changhua County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 10 days.

(21) Appl. No.: 14/084,619

(22) Filed: Nov. 20, 2013

(65) Prior Publication Data

US 2015/0049007 A1 Feb. 19, 2015

(30) Foreign Application Priority Data

Aug. 14, 2013 (TW) ..... 102129156 A

(51) Int. Cl.
*G09G 3/30* (2006.01)
*G09G 3/32* (2006.01)

(52) U.S. Cl.
CPC ..... *G09G 3/3233* (2013.01); *G09G 2320/043* (2013.01); *G09G 2310/0251* (2013.01)
USPC ..... 345/76; 315/169.3; 345/212

(58) Field of Classification Search
CPC . G09G 3/3233; G09G 3/3208; G09G 3/3225; G09G 3/3258; G09G 2320/0233; G09G 2300/0819; G09G 3/3291; G09G 2320/043; G09G 2320/045; G09G 3/30
USPC ..... 345/76–83, 212; 315/169.3
See application file for complete search history.

(56) References Cited

U.S. PATENT DOCUMENTS

| | | | | |
|---|---|---|---|---|
| 7,352,345 | B2 | 4/2008 | Li | |
| 8,274,457 | B2 * | 9/2012 | Tsai | 345/78 |
| 2006/0221662 | A1 * | 10/2006 | Park et al. | 365/145 |
| 2007/0296672 | A1 * | 12/2007 | Kim et al. | 345/92 |
| 2010/0007651 | A1 * | 1/2010 | Kim | 345/213 |
| 2012/0162175 | A1 * | 6/2012 | Fan et al. | 345/211 |
| 2013/0043802 | A1 * | 2/2013 | Han et al. | 315/240 |
| 2013/0113779 | A1 * | 5/2013 | Yoon et al. | 345/212 |
| 2013/0147690 | A1 * | 6/2013 | Kim et al. | 345/76 |
| 2013/0147694 | A1 * | 6/2013 | Kim et al. | 345/82 |
| 2014/0132583 | A1 * | 5/2014 | Kim | 345/212 |
| 2014/0139510 | A1 * | 5/2014 | Han et al. | 345/212 |
| 2014/0152719 | A1 * | 6/2014 | Jung | 345/691 |

FOREIGN PATENT DOCUMENTS

| | | |
|---|---|---|
| JP | 2004118196 A | 4/2004 |
| TW | I371736 | 9/2012 |

* cited by examiner

*Primary Examiner* — Dmitriy Bolotin
(74) *Attorney, Agent, or Firm* — CKC & Partners Co., Ltd.

(57) ABSTRACT

A pixel driving circuit of an organic light emitting diode includes a first transistor including a first terminal, a control terminal and a second terminal and a capacitor including a first terminal and a second terminal. The first terminal and the second terminal of the capacitor are electrically coupled to the first terminal and the control terminal of the first transistor at a first node and a second node respectively. In a first period, a power source does not provide a power supply voltage to the first node, and a data voltage and a variable voltage are written in the first node and the second node respectively. In a second period, the power source provides the power supply voltage to the first node. The first transistor provides a driving current to an organic light emitting diode based on the voltage of the first node and the second node.

10 Claims, 3 Drawing Sheets

PIXEL DRIVING CIRCUIT OF ORGANIC-LIGHT EMITTING DIODE

RELATED APPLICATIONS

This application claims priority to Taiwanese Application Serial Number 102129156, filed Aug. 14, 2013, which is herein incorporated by reference.

BACKGROUND

1. Field of Invention

The present invention relates to a pixel driving circuit, and more particularly, to the pixel driving circuit of an organic light-emitting diode 2. Description of Related Art In the conventional display device, the power source uses the wire to provides the voltage to the driving circuit; however, since the wire itself has the impedance, hence, the terminal end of the wire will inevitably have the problem of voltage degradation, and this phenomenon will cause the decrease of the driving current of the pixel of the organic light-emitting diode, such that the display device provides images with uneven brightness. With the development of technology, display devices with larger sizes are being developed, and the above-mentioned phenomenon is particularly severe in larger display devices.

Moreover, since the transistors used in the pixel driving circuit of the organic light-emitting diode are not exactly the same, hence, the manufacturing processes and component characteristics thereof are also different, and when the manufacturing processes are different or when other factors are different, it will result in the difference of the threshold voltages of the transistors; in this way, it also causes the uneven brightness of the display device.

Further, the life cycles of the components of the organic light-emitting diode are limited, and hence, the characteristics of the organic light-emitting diode will gradually degrade with the passage of the display time, which phenomenon will also affect the brightness of the organic light-emitting diode, thereby resulting in the uneven brightness of the display device.

SUMMARY

The present invention provides a pixel driving circuit of an organic light-emitting, which addresses the problem existed in the prior art.

For achieving the foregoing goal, one aspect of the present invention is related to a pixel driving circuit of an organic light-emitting diode. The pixel driving circuit of the organic light-emitting diode comprises a first transistor and a capacitor, in which the first transistor comprises a first terminal, a control terminal and a second terminal, and the capacitor comprises a first terminal and a second terminal. The first terminal of the first transistor is electrically coupled to power source, the second terminal of the first transistor is electrically coupled to the organic light-emitting diode, the first terminal of the capacitor is electrically coupled to the first terminal of the first transistor at a first node, and the second terminal of the capacitor is electrically coupled to the control terminal of the first transistor at a second node. In a first period, the power source does not provide a power supply voltage to the first node, data voltage is written in the first node, and a variable voltage is written in the second node. In a second period, the power source provides the power supply voltage to the first node, such that the voltage of the first node is pulled to the power supply voltage, and the voltage of the second node is correspondingly pulled to the sum of the variable voltage and the power supply voltage subtracting the data voltage, and the first transistor provides a driving current to the organic light-emitting diode based on the voltages of the first node and the second node.

In one embodiment of the present invention, the variable voltage is adjusted to compensate the driving current.

In another embodiment of the present invention, the data voltage is adjusted to compensate the driving current.

In yet another embodiment of the present invention, the driving current is calculated according to the equation as follows, $$I_{OLED}=K(V_{data}-V_R-|V_{TH}|^2);$$

wherein $I_{OLED}$ is the driving current, K is the conductivity coefficient of the first transistor, $V_{data}$ is the data voltage, $V_r$ is the variable voltage, and $V_{TH}$ is the threshold voltage of the first transistor.

In still another embodiment of the present invention, the variable voltage is adjusted to compensate the threshold voltage of the first transistor.

In yet another embodiment of the present invention, the data voltage is adjusted to compensate the threshold voltage of the first transistor.

In still another embodiment of the present invention, the organic light-emitting diode is electrically coupled to a reference voltage terminal, wherein the reference voltage terminal, in the first period, does not provide a reference voltage to the organic light-emitting diode, and the reference voltage terminal, in the second period, provides the reference voltage to the organic light-emitting diode.

In still another embodiment of the present invention, the pixel driving circuit of the organic light-emitting diode further comprises a second transistor and a third transistor. The second transistor and third transistor both comprise a first terminal, a control terminal and a second terminal. The first terminal of the second transistor is electrically coupled to the first node, the control terminal of the second transistor is electrically coupled to a scan line, and the second terminal of the second transistor is electrically coupled to a data line. The first terminal of the third transistor is electrically coupled to second node, the control terminal of the third transistor is electrically coupled to the scan line, and the second terminal of the third transistor is electrically coupled to a variable power source. In the first period, the scan line transmits a scan voltage to the control terminal of the second transistor and the control terminal of the third transistor, such that the second transistor is turned on and writes the data voltage in the first node, and the third transistor is tuned on and writes the variable voltage in the second node.

In yet another embodiment of the present invention, the first transistor is a P-type transistor, and the second and third transistors are N-type transistors.

In still another embodiment of the present invention, the first, second and third transistors are all P-type transistors.

In view of the foregoing, the embodiments of the present invention provide a driving circuit so as to improve the problem of uneven brightness of the display device arises from the voltage degradation, variation of threshold voltages of transistors, and degradation of characteristics of the organic light-emitting diode.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
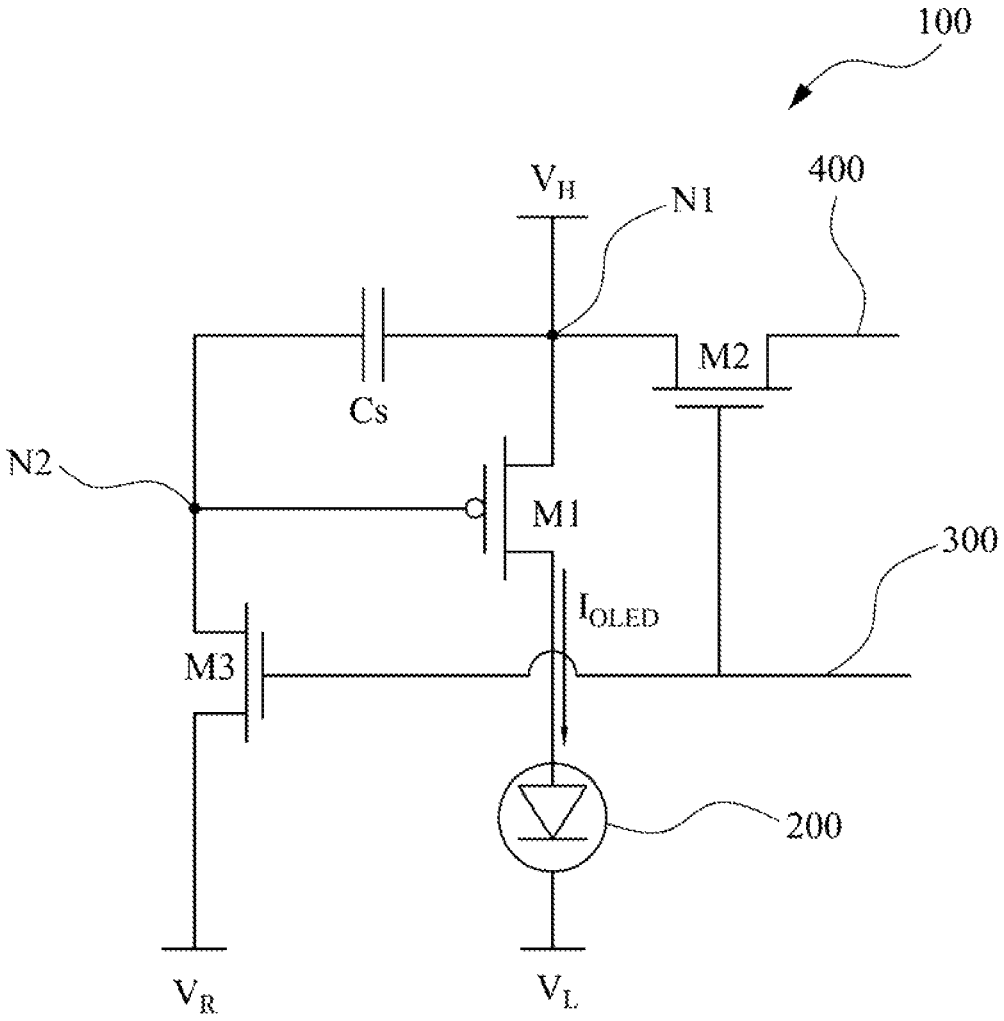
FIG. 1 shows a schematic diagram of a pixel driving circuit of an organic light-emitting diode according to one embodiment of the present invention.

FIG. 1 shows a schematic diagram of a pixel driving circuit 100 of an organic light-emitting diode according to one embodiment of the present invention. As illustrated in the drawing, the pixel driving circuit 100 of the organic light-emitting diode is used to drive the organic light-emitting diode 200. The pixel driving circuit 100 of the organic light-emitting diode comprises a first transistor M1 and a capacitor $C_s$; the first transistor M1 comprises a first terminal, a control terminal and a second terminal; the capacitor $C_s$ comprises a first terminal and a second terminal. The first terminal of the first transistor M1 is electrically coupled to a power source $V_H$, the second terminal of the first transistor M1 is electrically coupled to the organic light-emitting diode 200, the first terminal of the capacitor $C_s$ is electrically coupled to the first terminal of the first transistor M1 at a first node N1, and the second terminal of the capacitor $C_s$ is electrically coupled to the control terminal of the first transistor M1 at a second node N2.

Figure 2:
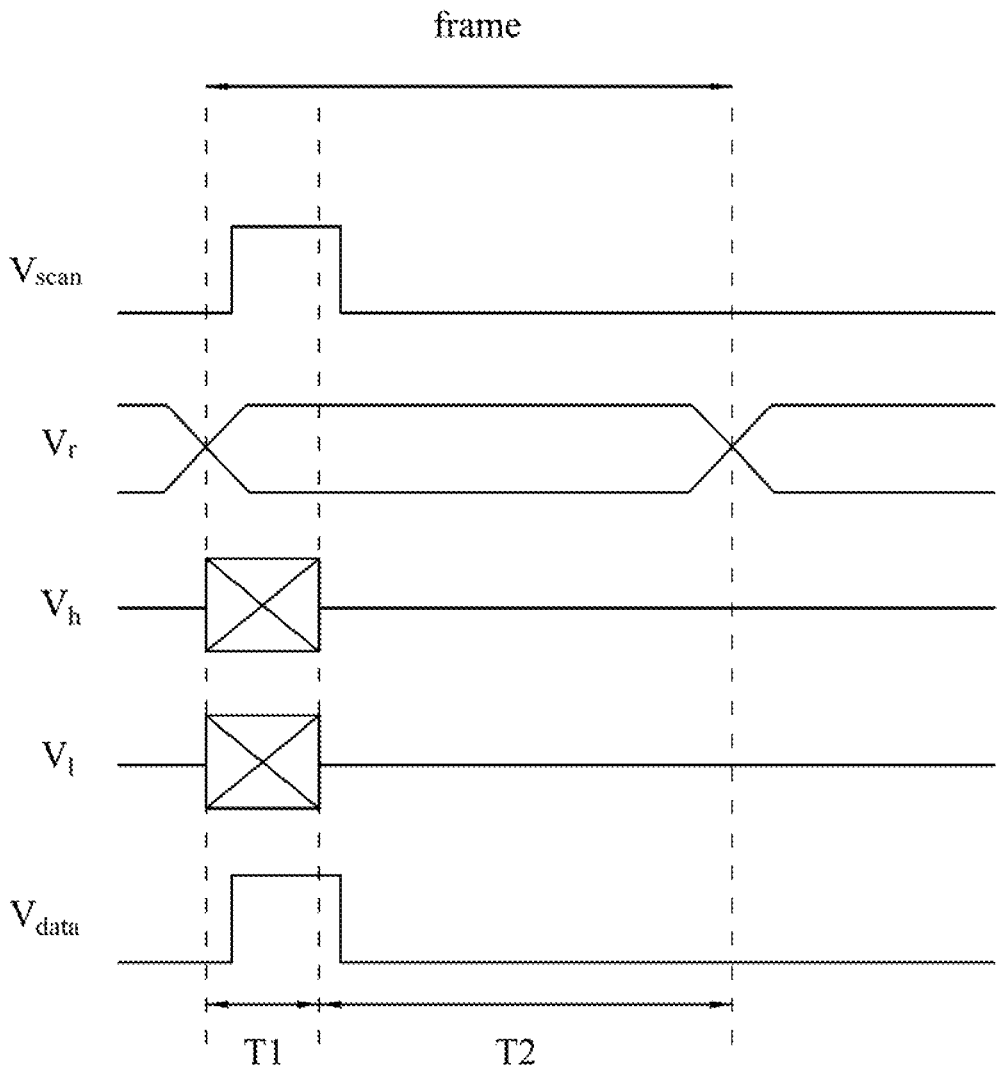
FIG. 2 shows a schematic diagram of the driving waveform of the pixel driving circuit of the organic light-emitting diode according to FIG. 1 of the present invention.

Further, to facilitate the understanding of the present invention further, reference is now made to FIG. 2 for illustratively explaining the present invention. FIG. 2 shows a schematic diagram of the driving waveform of the pixel driving circuit of the organic light-emitting diode according to FIG. 1 of the present invention, wherein $V_h$ is the power supply voltage outputted by the power source $V_H$. As illustrated in the drawing, in the first period T1, the power source $V_H$ does not provide the power supply voltage $V_h$ to the first node N1; at the same time, a data voltage $V_{data}$ is written in the first node N1, and a variable voltage $V_r$ is written in the second node N2.

In a second period T2, the power source $V_H$ provides the power supply voltage $V_h$ to the first node N1, such that the voltage of the first node N1 is pulled up to the power supply voltage $V_h$, and the voltage of the second node N2 is correspondingly pulled up to the sum of the variable voltage $V_r$ and the power supply voltage $V_h$ subtracting the data voltage $V_{data}$. Thereafter, the first transistor M1 can, based on the voltage of the first node N1 and the voltage of the second node N2, provide a driving current $I_{OLED}$ to the organic light-emitting diode 200.

In this way, since the variable voltage $V_r$ can be adjusted depending on the user's need, hence, when the power supply voltage $V_h$ provided by the power source $V_H$ via a wire experiences a voltage degradation, it is possible to adjust the variable voltage $V_r$ to compensate the degraded voltage; moreover, when the degradation of the characteristic of the organic light-emitting diode 200 results in the uneven brightness of the display device, it is possible to adjust the variable voltage $V_r$ to compensate the characteristic degradation of the organic light-emitting diode 200.

In conclusion, when the electronic components of the display device have different parameters or degrade, it is feasible to use the driving circuit 100 of the embodiments of the present invention to adjust the variable voltage $V_r$ so as to perform compensation, thereby improving the problem of uneven brightness of the display device, so as to enhance the display quality of the display device.

In the present embodiment, in addition to adjusting the variable voltage $V_r$ to compensate the driving current $I_{OLED}$, the data voltage $V_{data}$ can also be adjusted to compensate the driving current $I_{OLED}$; in this way, the level of the driving current $I_{OLED}$ can be maintained, thereby maintaining the brightness of the display device, and enhancing the display quality of the display device.

Regarding the driving current $I_{OLED}$, the original equation thereof is:

$$I_{OLED}=K(V_{SG}-|V_{TH}|)^2 \quad (1)$$

where $I_{OLED}$ is the driving current, K is the conductivity coefficient of the first transistor M1, $V_{SG}$ is voltage difference between the first terminal and the control terminal of the first transistor M1, and $V_{TH}$ is the threshold voltage of the first transistor M1.

In electrical operation, first, the driving circuit 100, in the first period T1, writes the data voltage $V_{data}$ in the first node N1; at the same time, writes the variable voltage $V_r$ in the second node N2. Next, the first node N1 of the driving circuit 100, in the second period, receives the power supply voltage $V_h$ provided by the power source $V_H$, such that the voltage of the first node N1 is pulled up to the power supply voltage $V_h$, and the voltage of the second node N2 is correspondingly pulled up to the sum of the variable voltage $V_r$ and the power supply voltage $V_h$ subtracting the data voltage $V_{data}$.

For example, the first terminal of the first transistor M1 can be a source, and the control terminal of the first transistor M can be a gate. Since the first node N1 is electrically coupled to the source of the first transistor M1, and the second node N2 is electrically coupled to the gate of the first transistor M1, in the second period T2, the voltage of the source of the first transistor M1 is $V_h$, and the voltage of the gate of the first transistor M1 is $V_r+V_h-V_{data}$. Substituting the above-mentioned voltages into the equation (1) would give the following equation:

$$I_{OLED}=K([V_h-(V_r+V_h-V_{data})-|V_{TH}|])^2 \quad (2)$$

wherein $V_{data}$ is the data voltage, $V_r$ is the variable voltage.

Further simplification of the equation (2) would give the following equation:

$$I_{OLED}=K(V_{data}-V_r-|V_{TH}|)^2 \quad (3)$$

In this way, when the electronic components of the display device have different parameters or degrade, as is apparent from the foregoing equations, it is possible to use the driving circuit 100 of the embodiments of the present invention to adjust the variable voltage V, to perform the compensation, so as to further improve the problem of the uneven brightness of the display device and enhance the display quality of the display device.

In the present embodiment, the variable voltage $V_r$ of the equation is adjusted to compensate the of threshold voltage $V_{TH}$ of the first transistor M1 moreover, the data voltage $V_{data}$ is also adjusted to compensate the threshold voltage $V_{TH}$ of the first transistor M1, such that the driving current $I_{OLED}$ is maintained stable, thereby maintaining the brightness of the display device and enhancing the display quality of the display device.

In the present embodiment, referring to both FIG. 1 and FIG. 2, the organic light-emitting diode 200 is electrically coupled to a reference voltage terminal $V_L$, wherein the reference voltage terminal $V_L$, in the first period T1, does not provide the reference voltage $V_I$ to the organic light-emitting diode 200, and said reference voltage terminal V only provides the reference voltage to the organic light-emitting diode 200 in the second period T2.

With reference to FIG. 1, the pixel driving circuit 100 of the organic light-emitting diode is configured to drive the organic light-emitting diode 200 of a display panel, and the display panel comprises a scan line 300 and a data line 400, wherein the pixel driving circuit 100 of the organic light-emitting diode further comprises a second transistor M2 and a third transistor M3. The second transistor M2 and the third transistor M3 both comprise a first terminal, a control terminal and a second terminal. The first terminal of the second transistor M2 is electrically coupled to the first node N1, the control terminal of the second transistor M2 is electrically coupled to the scan line 300, and the second terminal of the second transistor M2 is electrically coupled to the data line 400.

Further, the first terminal of the third transistor M3 is electrically coupled to the second node N2, the control terminal of the third transistor M3 is electrically coupled to the scan line 300, and the second terminal of the third transistor M3 is electrically coupled to the variable power source $V_R$.

Similarly, to further facilitate the understanding of the present invention, reference is now made to both FIG. 1 and FIG. 2. In the first period T1, the scan line 300 transmits a scan voltage $V_{scan}$ to the control terminal of the second transistor M2 and the control terminal of the third transistor M3, such that the second transistor M2 is turned on and writes the data voltage $V_{data}$ in the first node N1 and the third transistor M3 is turned on and writes the variable voltage $V_r$ in the second node N2, wherein the data voltage $V_{data}$ is outputted by the data line 400 and the variable voltage $V_r$ is outputted by the variable power source $V_R$.

In this way, the user may, depend on his/her needs, to use the variable power source $V_R$ to adjust the variable voltage $V_r$; hence, when the power supply voltage $V_h$ provided by the power source $V_H$ via a wire experiences a voltage degradation, it is possible to adjust the variable voltage $V_r$ to compensate the degraded voltage; moreover, when the difference among the threshold voltages of the transistors M1 to M3 or the degradation of the characteristic of the organic light-emitting diode 200 results in the uneven brightness of the display device, it is possible to adjust the variable voltage $V_r$ to compensate the characteristic degradation of the organic light-emitting diode 200.

In the present embodiment, with reference to FIG. 1, the first transistor M1 can be a P-type transistor, and the second and third transistors M2, M3 are N-type transistors. However, the present invention is not limited thereto, and suitable transistor types could be flexibly select depending on the actual need. In one embodiment, all of the first, second and third transistors M1 to M3 can be P-type transistors.

To validate the operation condition of the above-mentioned circuit, the present invention embodiment adopts the built-in Device Model of the Smart-SPICE to validate the driving circuit 100. The parameters used in the validation include, the W/L of the first transistor is 50/3.84 μm (P-type), the W/L of the second and third transistors is 8 μm/3.84 μm (n-type), Cs=2.5 pF, $V_{TH}$ of the first transistor is −3, $V_{TH}$ of the second and third transistors is 1, $V_{data}$=0~5 V, $V_{scan}$=−10~20 V, $V_r$=0~2 V, $V_h$=12 V, and $V_I$=0 V, wherein W is the width of the channel, L is the length of the channel, $V_{TH}$ is the threshold voltage of the transistor, $V_{data}$ is the data signal outputted by the data line, $V_{scan}$ is the scan signal outputted by the scan line 300, V is the variable voltage outputted by the variable power source $V_R$, $V_h$, is the power supply voltage outputted by the power source $V_H$, and $V_I$ is the reference voltage outputted by the reference voltage terminal $V_L$.

Figure 3:
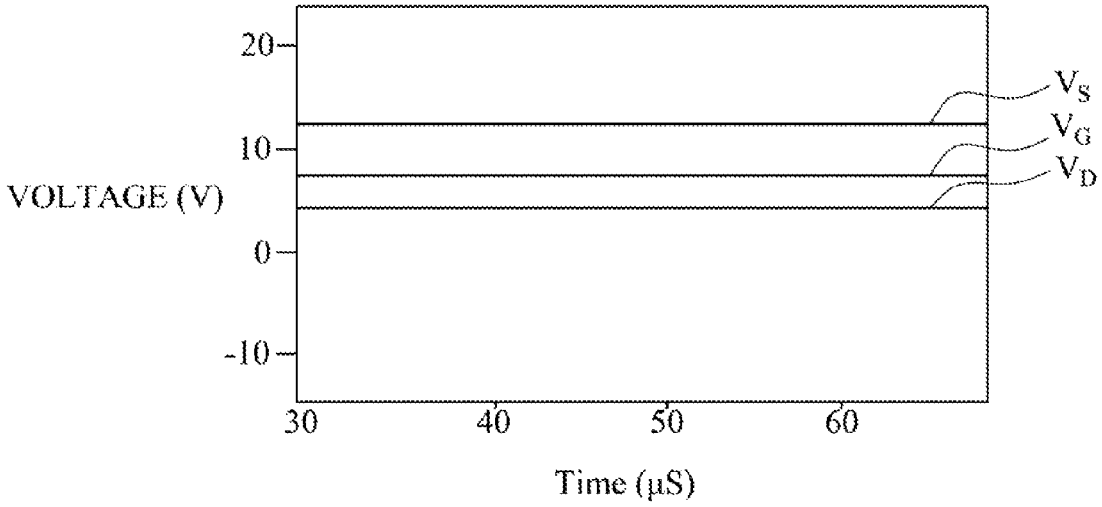
FIG. 3 shows a schematic diagram of the validation of the pixel driving circuit of the organic light-emitting diode according to FIG. 1 of the present invention.

The result of validation is summarized in FIG. 3 which shows a schematic diagram of the validation of the pixel driving circuit of the organic light-emitting diode according to FIG. 1 of the present invention. As illustrated in the drawing, after 30 μs, the voltage at each terminal point of the transistor M1 tends to be stable. As can be seen in the drawing, the voltage $V_S$ of the source (the first terminal) of the first transistor M1 is greater than the voltage $V_G$ of the gate (the control terminal) of the first transistor M1, and the voltage $V_G$ of the gate (the control terminal) of the first transistor M1 is greater than the voltage $V_D$ of the drain (the second terminal) of the first transistor M1; since the first transistor M1 is a P-type transistor, the above-mentioned electrical condition can allow the first transistor M1 to be in a saturation mode; in this way, it is possible to ensure that the driving circuit 100 of embodiments of the present invention can adjust the variable voltage $V_r$ so as to compensate the decrease of the driving current $I_{OLED}$ caused by the parameter variation among the components in the circuit, and therefore, improve the problem of the uneven brightness of the display device.

In view of the foregoing embodiments of the present invention, many advantages of the present invention are now apparent. The embodiment of the present invention provides a driving circuit to improve the problem of the uneven brightness of the display device caused by the voltage degradation, difference of threshold voltages of transistors and the characteristic degradation of the organic light-emitting diode.

What is claimed is:

1. A pixel driving circuit of an organic light-emitting diode, comprising:

a first transistor, comprising:

a first terminal, electrically coupled to a power source;

a control terminal; and a second terminal, electrically coupled to an organic light-emitting diode; and a capacitor, comprising:

a first terminal, electrically coupled to the first terminal of the first transistor at a first node; and a second terminal, electrically coupled to the control terminal of the first transistor at a second node;

wherein in a first period, the power source does not provide a power supply voltage to the first node, and a data voltage is written in the first node and a variable voltage is written in the second node; and wherein in a second period, the power source provides the power supply voltage to the first node, such that the voltage of the first node is pulled up to the power supply voltage, and the voltage of the second node is correspondingly pulled up to the sum of the variable voltage and the power supply voltage subtracting the data voltage, and the first transistor provides a driving current to the organic light-emitting diode based on the voltage of the first node and the voltage of the second node.

2. The pixel driving circuit of an organic light-emitting diode according to claim 1, wherein the variable voltage is adjusted to compensate the driving current.

3. The pixel driving circuit of an organic light-emitting diode according to claim 1, wherein the data voltage is adjusted to compensate the driving current.

4. The pixel driving circuit of an organic light-emitting diode according to claim 1, wherein the driving current is calculated according to the equation as follows:

$$I_{OLED}=K(V_{data}-V_r-|V_{TH}|)^2;$$

wherein $I_{OLED}$ is the driving current, K is the conductivity coefficient of the first transistor, $V_{data}$ is the data voltage, $V_r$ is the variable voltage, $V_{TH}$ is a threshold voltage of the first transistor.

5. The pixel driving circuit of an organic light-emitting diode according to claim 4, wherein the variable voltage is adjusted to compensate the threshold voltage of the first transistor.

6. The pixel driving circuit of an organic light-emitting diode according to claim 4, wherein the data voltage is adjusted to compensate the threshold voltage of the first transistor.

7. The pixel driving circuit of an organic light-emitting diode according to claim 1, wherein the organic light-emitting diode is electrically coupled to a reference voltage terminal, wherein in the first period, the reference voltage terminal does not provide a reference voltage to the organic light-emitting diode, and in the second period, the reference voltage terminal provides the reference voltage to the organic light-emitting diode.

8. The pixel driving circuit of an organic light-emitting diode according to claim 1, further comprising:

a second transistor, comprising:

a first terminal, electrically coupled to the first node;

a control terminal, electrically coupled to a scan line; and a second terminal, electrically coupled to a data line; and a third transistor, comprising:

a first terminal, electrically coupled to the second node;

a control terminal, electrically coupled to the scan line; and a second terminal, electrically coupled to a variable power source;

wherein in the first period, the scan line transmits a scan voltage to the control terminal of the second transistor and the control terminal of the third transistor, such that the second transistor is turned on and writes the data voltage in the first node, and the third transistor is turned on and writes the variable voltage in the second node.

9. The pixel driving circuit of an organic light-emitting diode according to claim 8, wherein the first transistor is a P-type transistor, and the second and third transistors are N-type transistors.

10. The pixel driving circuit of an organic light-emitting diode according to claim 8, wherein the first, second and third transistors are all P-type transistors.

* * * * *